US006680671B2

(12) United States Patent
Okamoto et al.

(10) Patent No.: US 6,680,671 B2
(45) Date of Patent: Jan. 20, 2004

(54) FIRE DETECTION DEVICE

(75) Inventors: Mikihiro Okamoto, Kawasaki (JP); Takahiro Aoki, Kawasaki (JP); Morito Shiohara, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 165 days.

(21) Appl. No.: 09/812,561

(22) Filed: Mar. 21, 2001

(65) Prior Publication Data

US 2002/0021221 A1 Feb. 21, 2002

(30) Foreign Application Priority Data

Jul. 18, 2000 (JP) ..... 2000-217097

(51) Int. Cl.[7] ..... G08B 17/12
(52) U.S. Cl. ..... 340/578; 250/339.15
(58) Field of Search ..... 340/577, 578, 340/584, 587; 250/554, 339.15; 348/143

(56) References Cited

U.S. PATENT DOCUMENTS 4,665,390 A * 5/1987 Kern et al. ..... 340/587
4,749,987 A * 6/1988 Ishii ..... 340/587
5,510,772 A * 4/1996 Lasenby ..... 340/578
5,796,342 A * 8/1998 Panov ..... 340/577
5,838,242 A * 11/1998 Marsden ..... 340/577 X

FOREIGN PATENT DOCUMENTS

JP 11134571 A 5/1999

* cited by examiner

*Primary Examiner*—Thomas Mullen
(74) *Attorney, Agent, or Firm*—Staas & Halsey LLP

(57) ABSTRACT

A fire detection device luminance data over a time period longer than a repetition period of movement of a flame, to generate resampled data, and a device that calculates an average value of N (natural number equal to or larger than 2) items of the resampled data, and determines that the input image is an image of a flame, by comparing a count of sampled data items larger than the average value, or a count of sampled data items smaller than the average value, with a predetermined value.

34 Claims, 13 Drawing Sheets

T1 TABLE

| TEST STATISTIC m | SIGNIFICANT PROBABILITY Pm | |
|---|---|---|
| 0 | 0.00% | ← P0 |
| 1 | 0.00% | ← P1 |
| 2 | 0.00% | |
| 3 | 0.00% | |
| 4 | 0.01% | |
| 5 | 0.03% | |
| 6 | 0.14% | |
| 7 | 0.52% | |
| 8 | 1.61% | |
| 9 | 4.28% | |
| 10 | 9.87% | |
| 11 | 20.05% | |
| 12 | 36.16% | |
| 13 | 58.47% | |
| 14 | 85.55% | ← P14 |

IN THE CASE OF SIGNIFICANT LEVEL BEING SET TO 1%, IT IS DETERMINED THAT IMAGE IS NOT OF MOVING FLAME (i.e., IS OF MOVING OBJECT) WHEN SIGNIFICANT PROBABILITY IS ON THIS SIDE

FIG. 7

T2 TABLE

| TEST STATISTIC $S/\sigma^2$ | SIGNIFICANT PROBABILITY Pm | |
|---|---|---|
| 1 | 100.0% | ← P0 |
| 5 | 100.0% | ← P1 |
| 10 | 100.0% | |
| 15 | 98.5% | |
| 20 | 89.3% | |
| 25 | 67.8% | |
| 30 | 41.4% | |
| 35 | 20.5% | |
| 40 | 8.4% | |
| 41 | 6.9% | ⇧ NOISE |
| 42 | 5.6% | |
| 43 | 4.6% | IN THE CASE OF SIGNIFICANT LEVEL BEING SET TO 5% |
| 44 | 3.7% | ⇩ NOT NOISE |
| 45 | 2.9% | |
| 50 | 0.9% | |
| 55 | 0.2% | |
| 60 | 0.1% | ← P60 |

FIG. 12

FIRE DETECTION DEVICE

BACKGROUND OF THE INVENTION (1) Field of the Invention

This invention relates to a fire detection device, and more particularly to a fire detection device for detecting a fire.

(2) Description of the Related Art

Conventionally, a fire detection device is put into practical use in the form of a device utilizing a thermograph, a radiation-based fire detection device, or a device using a visible light camera.

A thermograph recognizes an occurrence of a fire when it detects a temperature higher than 350° C. The radiation-based fire detection device detects a radiation having a wavelength (e.g., 4.3 $\mu$m) of an infrared ray to be emitted from flames and a radiation of a wavelength (e.g., 2.5 $\mu$m) other than the wavelength of the infrared ray, and determines an occurrence of a fire based on the detected radiations. Further, the device using a visible light camera compares the luminance of each point of an image taken by the visible light camera with a predetermined threshold value, and extracts a portion of the image having detected luminance values higher than the predetermined threshold value, for determination of an occurrence of a fire.

On the other hand, a fire detection device proposed in Japanese Laid-Open Patent Publication (Kokai) No. 11-134571 determines a variance of luminance for each pixel of an input image supplied by a camera, and discriminates a flame from noise based on a degree of the variance, to detect a fire.

However, these conventional fire detection devices suffer from the following problems: Although a thermograph provides a highly accurate fire detection, a sensor used for the thermograph is very expensive, so that this device cannot be widely used due to its high cost.

In the case of the radiation-based fire detection device, it uses a single element for a wide field of view, and is incapable of determining the location of a fire. Therefore, this device is not suitable for monitoring a wide area for fire detection.

Further, the device for detecting a fire by using a visible light camera can realize a high-accuracy detection in a site used for a limited purpose, such as the inside of a tunnel, where there occur only small changes in environmental conditions. However, at locations where environmental conditions undergo violent changes, such as outdoors, there is a fear of erroneous detections due to camera movement, the weather, etc. To cope with all environmental conditions, a complicated image processing is required.

On the other hand, in the case of discrimination of a flame from noise based on the degree of the variance, the setting of the predetermined threshold value is a critically important matter in designing of the device. However, in the prior art disclosed in the aforementioned Japanese Laid-Open Patent Publication (Kokai) No. 11-134571, the setting of the threshold value is not quantitatively determined, which makes it impossible to positively discriminate a moving flame from noise.

Further, in this conventional technique, the threshold value is qualitatively set for each point where fire detection is required, based on the measured variance conditions, and hence the conventional technique suffers from a poor working efficiency, and lack of flexibility.

SUMMARY OF THE INVENTION

The present invention has been made in view of the above circumstances, and an object thereof is to provide a fire detection device which is capable of monitoring a wide area, and detecting a fire with efficiency and high accuracy, without necessitating a complicated image processing.

To attain the above object, there is provided a fire detection device for detecting a fire. The fire detection device is characterized by comprising luminance data extraction means for extracting luminance data from an input image, resampling means for carrying out resampling of the luminance data over a time period longer than a repetition period of movement of a flame, to generate resampled data, and fire detection means for calculating an average value of N (natural number equal to or larger than 2) items of the resampled data, and determining that the input image is an image of a flame, by comparison between a count of sampled data items larger than the average value or a count of sampled data items smaller than the average value and a predetermined value.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 7 is a diagram showing a table of values of a test statistic m and values of a significant probability Pm;

FIG. 12 is a diagram showing another table of values of a test statistic and values of a significant probability.

DESCRIPTION OF THE PREFERRED EMBODIMENTS

Figure 1:
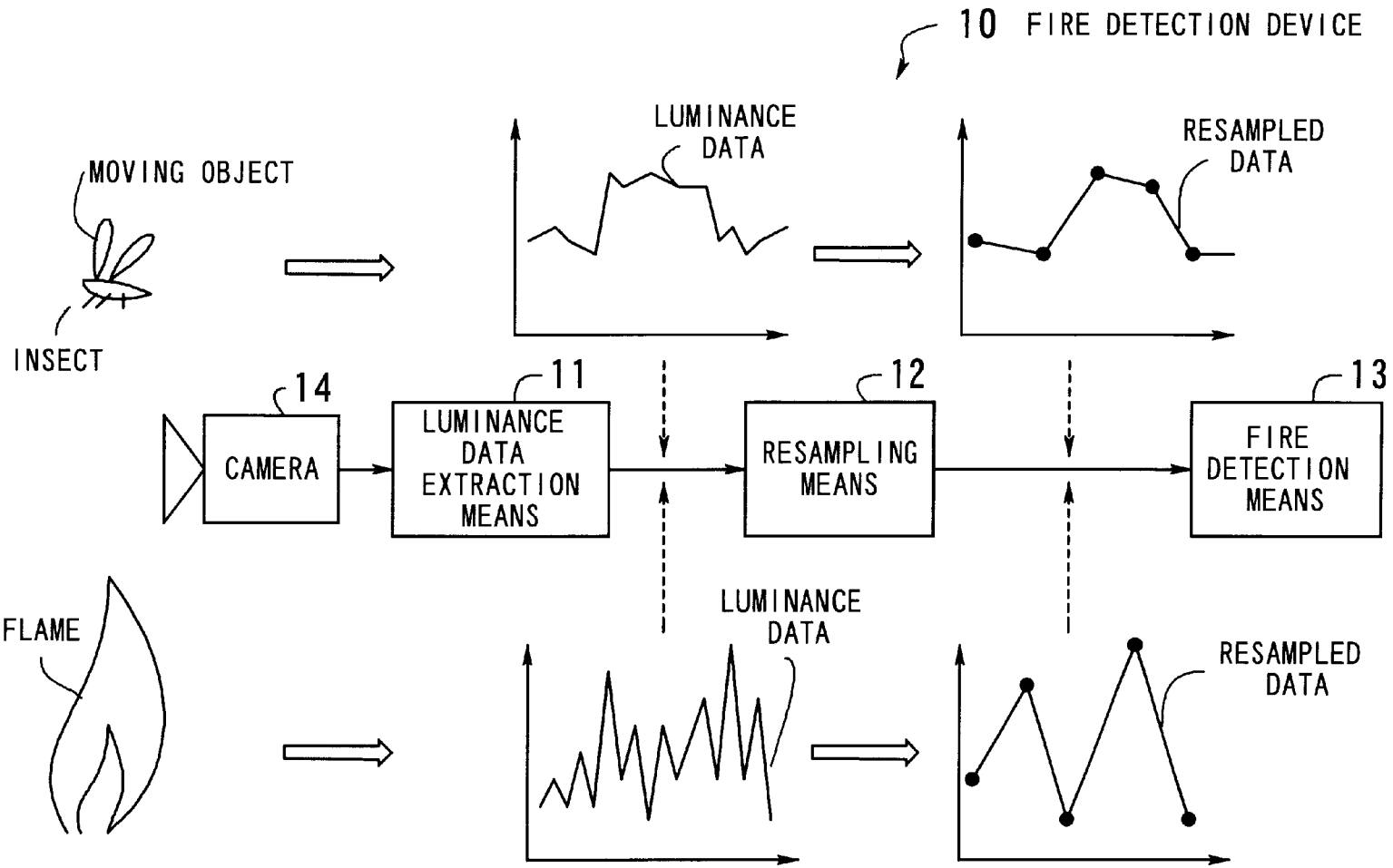
FIG. 1 is a diagram showing the operating principles of a fire detection device.

Now, preferred embodiments of the present invention will be described below with reference to accompanying drawings. FIG. 1 shows the operating principles of a fire detection device according to the invention. The fire detection device 10 monitors a wide range of indoor or outdoor areas by a camera (infrared camera or the like) 14, and processes an image taken thereby to detect a fire. Then, the device 10 delivers a fire alarm to a host system and notifies the same of the location of the fire.

Luminance data extraction means 11 stores an image input from the camera in a frame memory, as a collection of luminance values along a time axis.

Resampling means 12 carries out resampling of luminance data over a longer time period than a repetition period of movement of a flame to produce resampled data. This will be described in detail hereinafter with reference to FIGS. 4 and 5.

Fire detection means 13 detects a fire based on an average value of the resampled data and signs indicative of a resampled data item being above the average value and a resampled data item being below the same, respectively. In this case, statistical processing is carried out based on a distribution of occurrences of signs with the average value as the center, or changes in the sign with respect to the average value, whereby a moving flame is discriminated from a moving object, for detection of a fire. Details of the processing will be described hereinafter with reference to FIGS. 6 to 10. Further, methods of discrimination of a fire from noise will be described with reference to FIG. 11 et seq.

Figure 2:
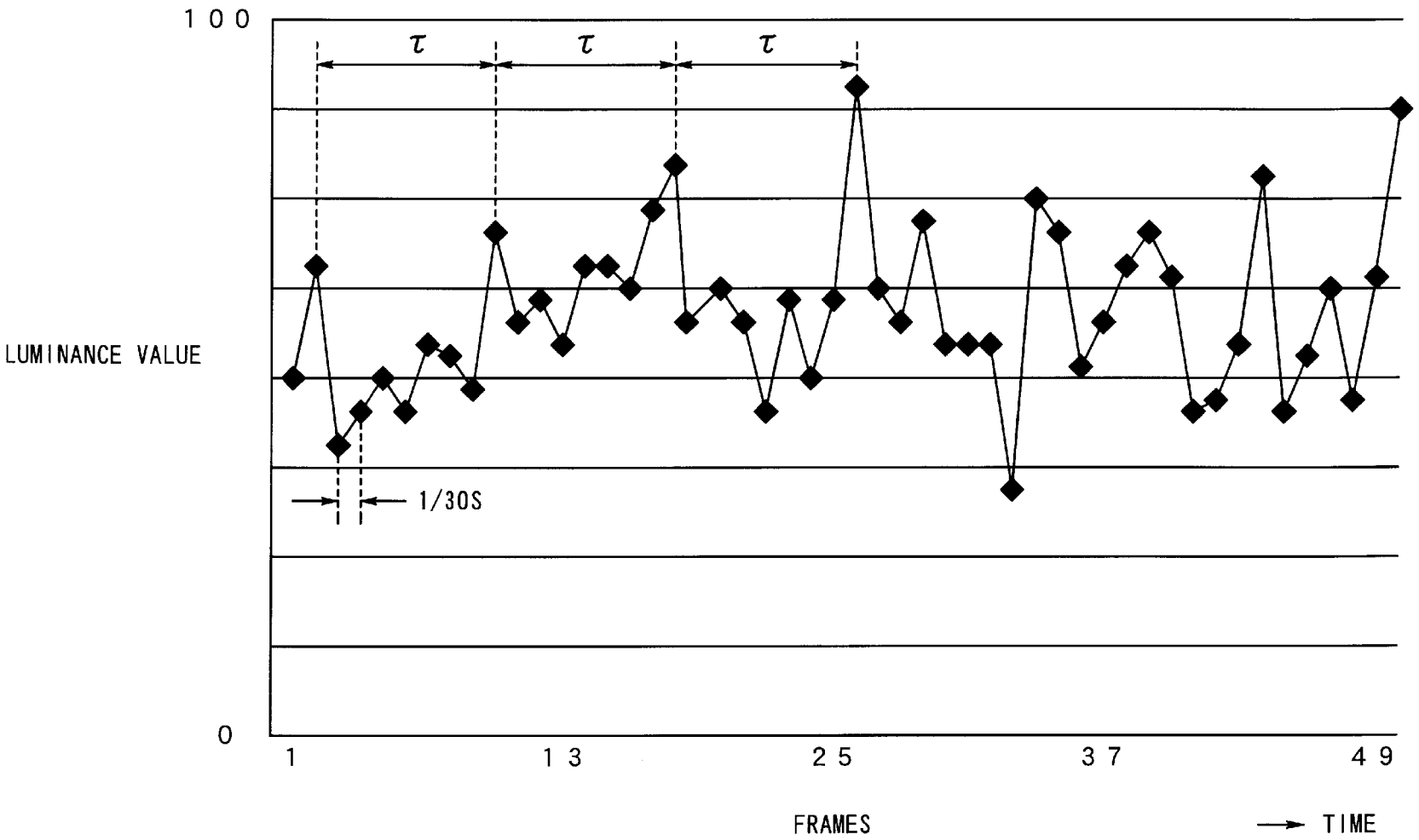
FIG. 2 is a diagram showing changes in the luminance value of a moving flame.
Figure 3:
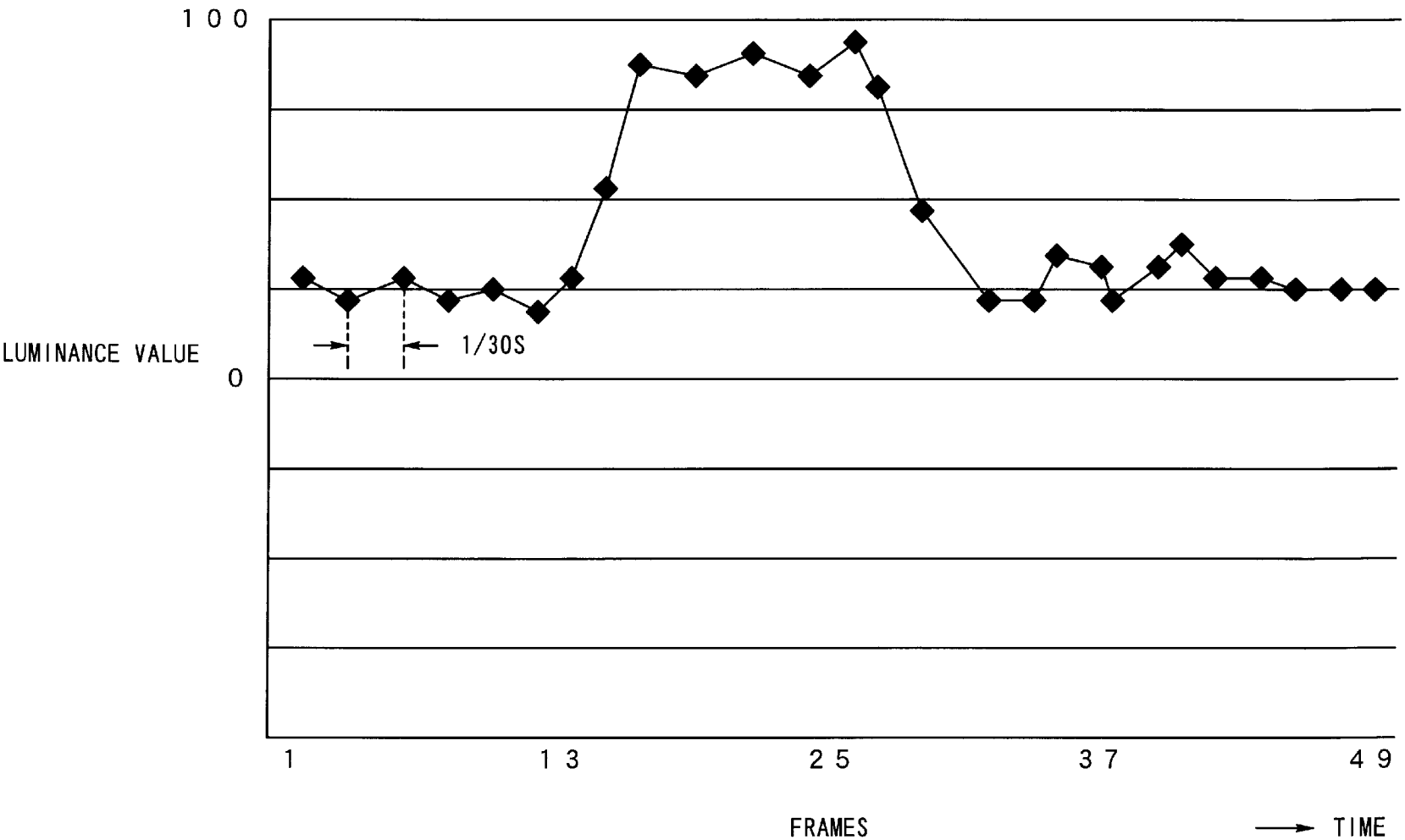
FIG. 3 is a diagram showing changes in the luminance value of a moving object.

Now, changes in the luminance value will be described. FIG. 2 shows changes in the luminance value of a moving flame (upper tongue of the flame), while FIG. 3 shows changes in the luminance value of a moving object. In both cases, measurement is made on a certain point in an image over a plurality of frames, with its ordinate representing luminance values and its abscissa representing frames.

While it is known that the movement of a flame has a periodicity (repetition period of changes is represented by .) as shown in FIG. 2, in the case of a moving object, it is understood from FIG. 3 that the line indicative of changes in the luminance value forms a protruding portion when the object moves, but remains substantially flat when the object remains stationary.

Figure 4:
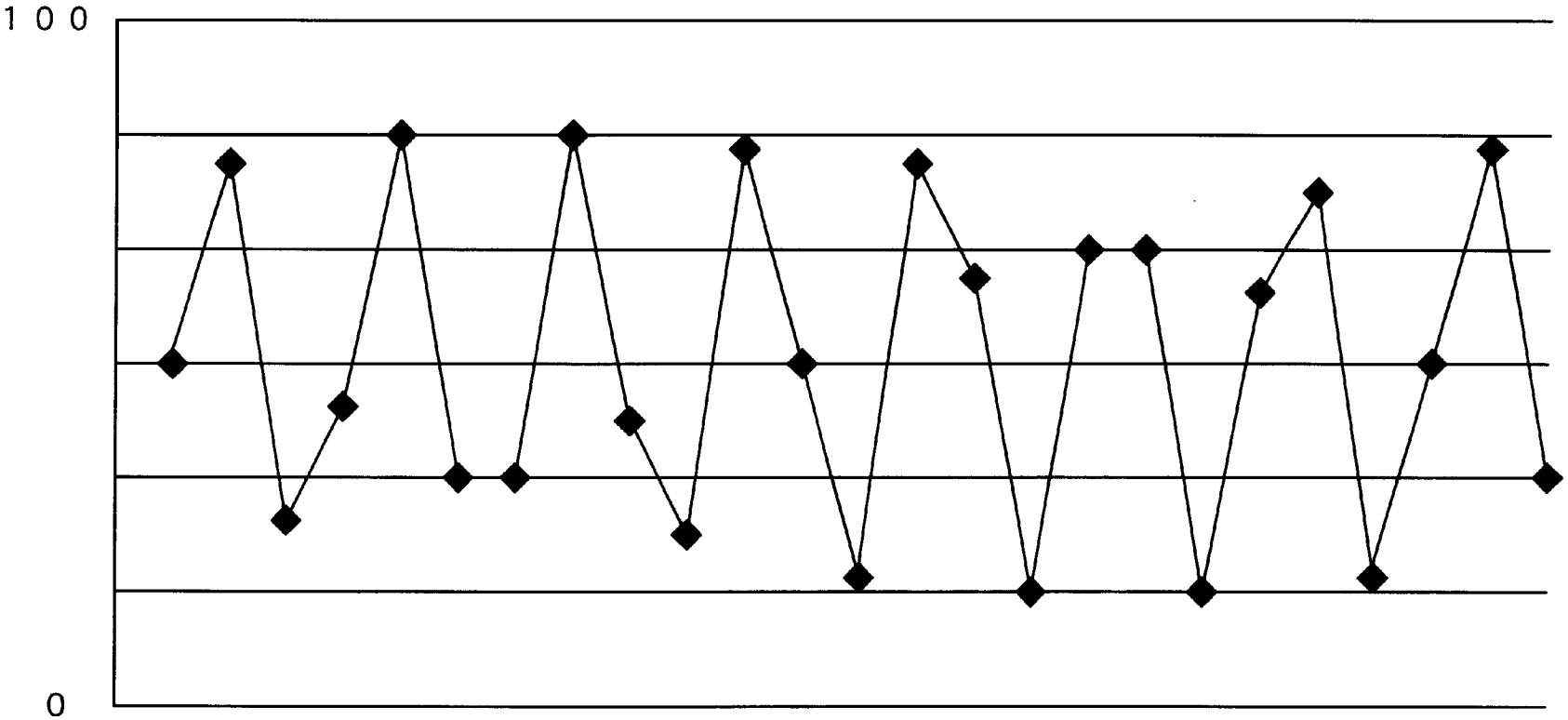
FIG. 4 is a diagram showing a waveform of resampled data generated by resampling the changes in the luminance value of a flame.

Next, the resampling carried out by the present embodiment will be described. FIG. 4 is a diagram showing a waveform of resampled data formed by resampling changes in the luminance value of a flame shown in FIG. 2, while FIG. 5 is a diagram showing a waveform of resampled data formed by resampling changes in the luminance value of a moving object shown in FIG. 3.

As described hereinabove, the component of data representative of movement of a flame does not present a normal distribution, but it has a periodicity. In view of this, the present invention carries out resampling of changes in the luminance value by setting the sampling time T to a longer time period than the repetition period $\tau$ of movement of the flame ($\tau<T$).

As a result, numerical value data (resampled data) in random form is obtained which exhibits random changes as shown in FIG. 4, from the FIG. 2 luminance data having a periodicity representative of periodic changes in the luminance value of a moving flame.

Figure 5:
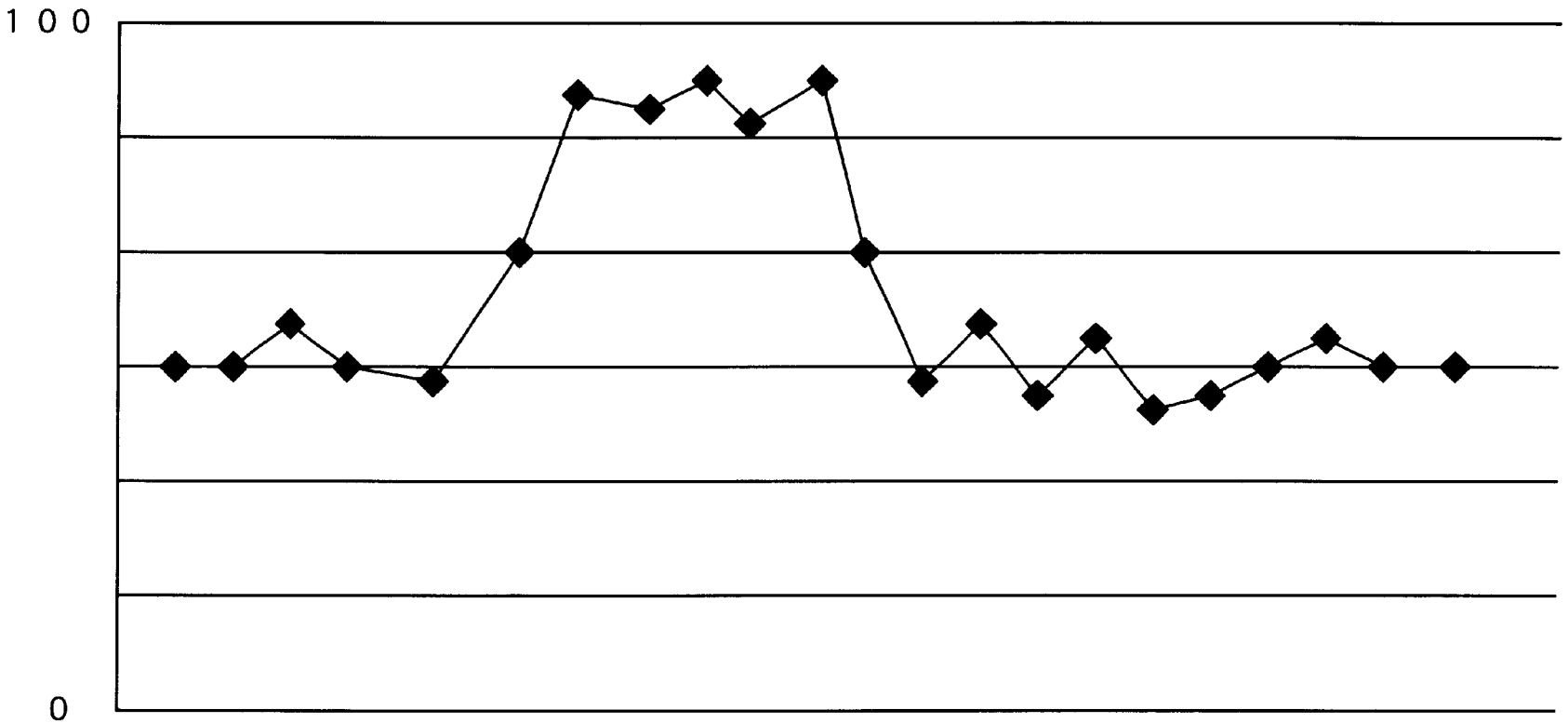
FIG. 5 is a diagram showing a waveform of resampled data generated by resampling the changes in the luminance value of a moving object.

Further, resampling of changes in the luminance value of a moving object carried out by using a repetition period T similar to one employed for the moving flame provides numerical data (resampled data) exhibiting a waveform, as shown in FIG. 5, which is similar to an original waveform representative of the changes.

Thus, the present invention resamples the luminance data to form a randomized resampled data (luminance value represented by the resampled data is an independent one). Then, statistical processing is carried out on the resampled data to discriminate a moving flame from a moving object, for detection of a fire.

Figure 6:
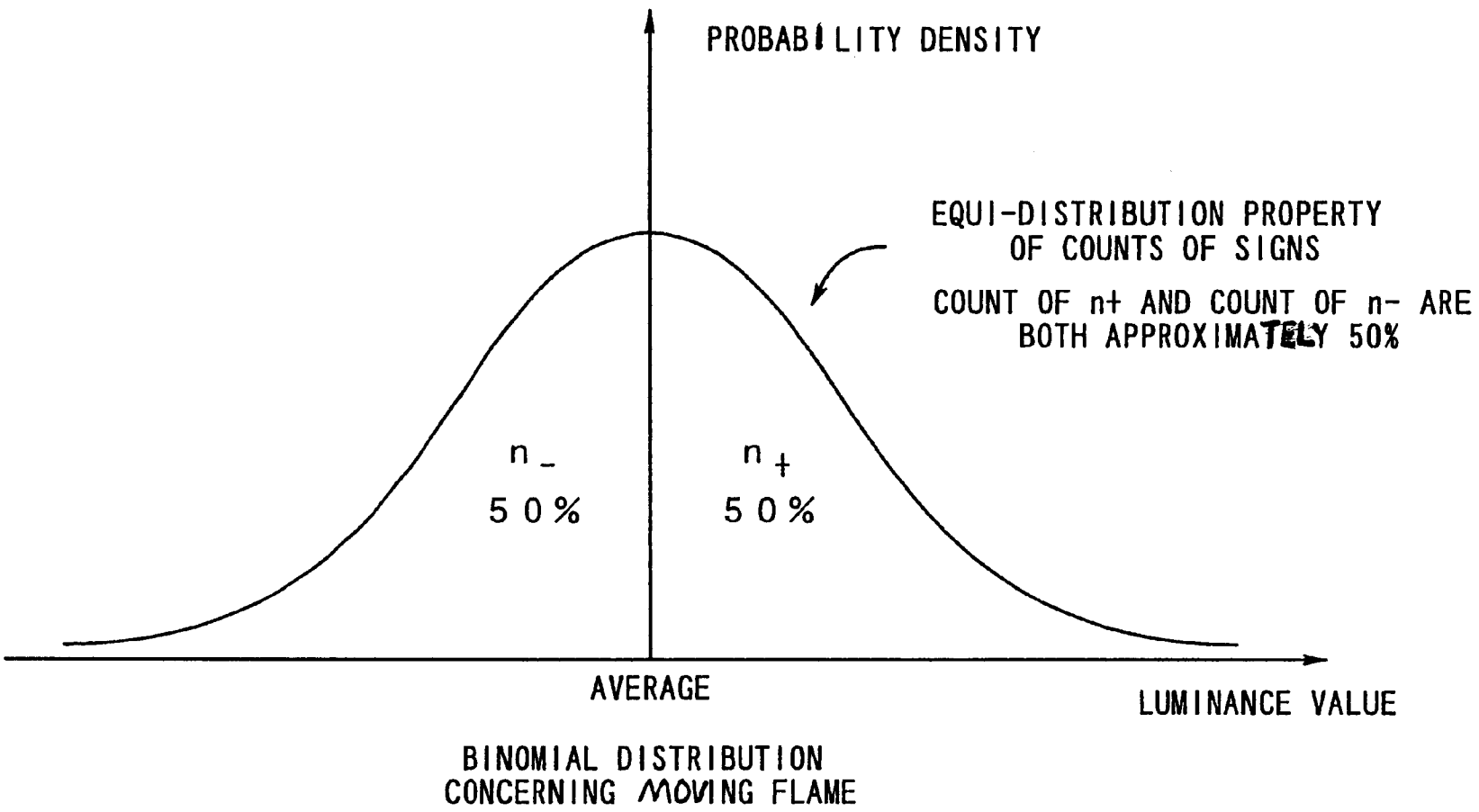
FIG. 6 is a diagram showing a distribution of resampled data obtained from a moving flame.

Next, a first embodiment of the invention will be described in which the fire detection means 13 carries out statistical processing for fire detection. FIG. 6 shows a distribution of resampled data obtained from a moving flame, with the ordinate representing values of probability density and the abscissa representing luminance values of the resampled data.

The resampled data $n_i$ (i=1 to N) obtained from an ideal moving flame do not have a periodicity, and hence from a probability analysis, when the average value:

$$\overline{n_i} \cdot \left( \sum_{i=1}^{N} \cdots \right.$$

of luminance values of the resampled data is set to a center of the graph of this distribution, the count i, which satisfies a condition expressed by the following equation:

$$n_i \cdot \overline{n_i}$$

of sampled data items $n_i$ on the right side of the average value in the graph, and the count i, which satisfies a condition expressed by the following equation:

$$n_i \cdot \overline{n_i}$$

of sampled data items $n_i$ on the left side of the average value should be approximately equal to each other.

That is, the probability of a luminance value becoming larger than the average value and the probability of a luminance value becoming smaller than the average value are both considered to be ½.

Now, description will be made of an example of a method of determining from the luminance data whether an object of which an image is taken is a flame or a moving object other than the flame.

First, the two concepts of a test statistic and a significant probability are introduced. A test statistic m is defined to be the smaller of $n_+$ and $n_+$. Further, a significant probability Pm in this embodiment is defined as a probability of a test statistic becoming smaller than m.

FIG. 7 shows the relationship between the test statistic m and the significant probability Pm in a tabular form, which is determined from the characteristics of an ideal moving flame (in which the probability of a luminance value being above the average value and the probability of a luminance value being below the average value are both equal to ½). It should be noted that the number N of resampled data items used for calculation is assumed to be equal to 30 (N=30).

The significant probability PM is determined by using the following equation:

$$P_m = \sum_{i=0}^{m} {}_N C_i (1/2)^i (1/2)^{N-i} \tag{1}$$

From the table, it will be understood that when the ideal flame is monitored by a camera, the significant probability Pm does not even reach 1%, when the test statistic m is 7 or lower, but it exceeds 1% only when the test statistic m is equal to or greater than 8.

Therefore, by calculating the test statistic m from luminance data obtained from an image of an object taken by a camera, it is possible to determine whether the object is a flame or a moving object other than the flame.

More specifically, if a test statistic m calculated from the luminance data is 4, for instance, a significant probability Pm obtained from FIG. 7 is equal to 0.01%, which means the probability of the object being a flame is very small.

Therefore, the object of which the image is taken by the camera can be regarded as a moving object. It should be noted that a threshold value of the test statistic for determining whether the object is a flame or a moving object other than the flame can be set to 8, for instance.

That is, when a test statistic is equal to or larger than 8, it is determined that the camera takes an image of a flame, whereas when the test statistic is smaller than 7, it is determined that the camera takes an image of a moving object or the like, but not of a flame. It should be noted that the threshold value can be set as desired with reference to the significant probability, but as the threshold value is set to a larger value of the test statistic, the significant level of the probability of the object being a flame is increased.

It should be noted that in this embodiment, the fire detection means 13 stores a threshold value for determining whether an object is a flame or a moving object other than the flame in a memory or the like, and calculates a test statistic from the luminance data of an image taken by the camera, for determining that the object is not a flame if the calculated test statistic is lower than the threshold value, and that the same is a flame if the calculated value exceeds the threshold value. Though not shown in the figures, the result of the determination is displayed on a screen, an alarming sound is issued, or other notification is given.

As described heretofore, according to the first embodiment of the invention, by paying attention to the moving characteristics of a flame (in which, when an image of a flame is taken by a camera, the number of luminance data above the average value, which is in the center, and the number of luminance data below the same are equal to each other), when luminance data obtained concerning an object has characteristics conforming to the above characteristics or close thereto, it is determined that the camera takes an image of a flame, whereas if the luminance data has characteristics far from the above characteristics, it is determined that the camera takes an image of a moving object or something other than a flame. Although in the present embodiment, the concepts of the test statistic and the significant probability are introduced, this is not limitative, but another calculating method may be employed as the method of determining whether the luminance data obtained concerning an object has characteristics conforming to or close to the characteristics of a moving flame. For example, there may be employed a method of calculating a difference ($|H-L|$) between the number (H) of data indicative of luminance values larger than the average value and the number (L) of data indicative of luminance values smaller than the average value, and determining that the object is a flame when the difference is smaller than a predetermined value, and that the object is not a flame when the difference exceeds the predetermined value.

Next, a second embodiment of the invention will be described, in which movement of a flame (a moving flame) is discriminated from movement of an object (a moving object) based on a distribution of changes in a sign (e.g. (+) or (−)) indicative of whether a luminance value is equal to or larger than an average value thereof or smaller than the same (i.e. changes of luminance data input in time series, across an average value of the luminance data).

Resampled data obtained from a moving flame has no periodicity, and hence from a probability analysis, the number or count of occurrences of no changes in sign (i.e., from (+) indicating that the value is equal to or larger than the average value to (+), or from (−) indicating that the value is smaller than the average value to (−)) and the number or count of occurrences of changes in sign (from (+) to (−) or from (−) to (+)) should be equal to each other.

On the other hand, in the case of the moving object, there are more occurrences of no changes in sign than changes in sign. Now, the smaller one of the number of occurrences of changes in sign and the number of occurrences of no changes in sign is set to a test statistic m, and the significance probability Pm is set to a probability of the test statistic m, i.e., a probability of the test statistic becoming smaller than m. Assuming that the number N of resampled data of luminance data is set to 30, the relationship between m and Pm is as shown in FIG. 7.

In the second embodiment, determination of whether an object is a flame or a moving object may be carried out by setting the threshold value of a test statistic to e.g., 8, calculating a test statistic of resampled data of luminance data of an image taken by a camera, and determining that the image is of a flame if the calculated test statistic is larger than 8, and that the image is a moving object if the calculated test statistic is equal to or smaller than 8.

It should be noted that the method is not limited to the above example, but there may be calculated the number of occurrences of changes in sign per predetermined time period, for comparison of the calculated number with a predetermined value. If the former exceeds the latter, it is judged that the movement is violent, and hence it is determined that the image is of a flame, whereas if the former is smaller than the latter, it is judged that the swaying is gentle and hence it is determined that the object is not of a flame. The predetermined time period and the predetermined number can be set to respective appropriate values based on data obtained of an ideal moving flame.

As described above, in the second embodiment, statistical processing is carried out based on an equi-distribution property of the number or count of occurrences of changes in sign of luminance values of resampled data indicative of whether a luminance value is equal to or larger than an average value thereof and the number or count of occurrences of no changes in sign, whereby a moving flame is discriminated from a moving object, for detection of a fire. This makes it possible to efficiently detect a fire with high accuracy.

Next, a third embodiment of the invention is described in which the fire detection means obtains a histogram from luminance data, and statistical processing is carried out on the histogram to detect a fire.

The third embodiment is distinguished from the first and second embodiments in which luminance data of an input image is further resampled to form resampled data, and then statistical processing is carried out on the resampled data, in that instead of resampling, luminance data is extracted from an input image over a long time period, and a histogram is obtained from the extracted luminance data.

Figure 8:
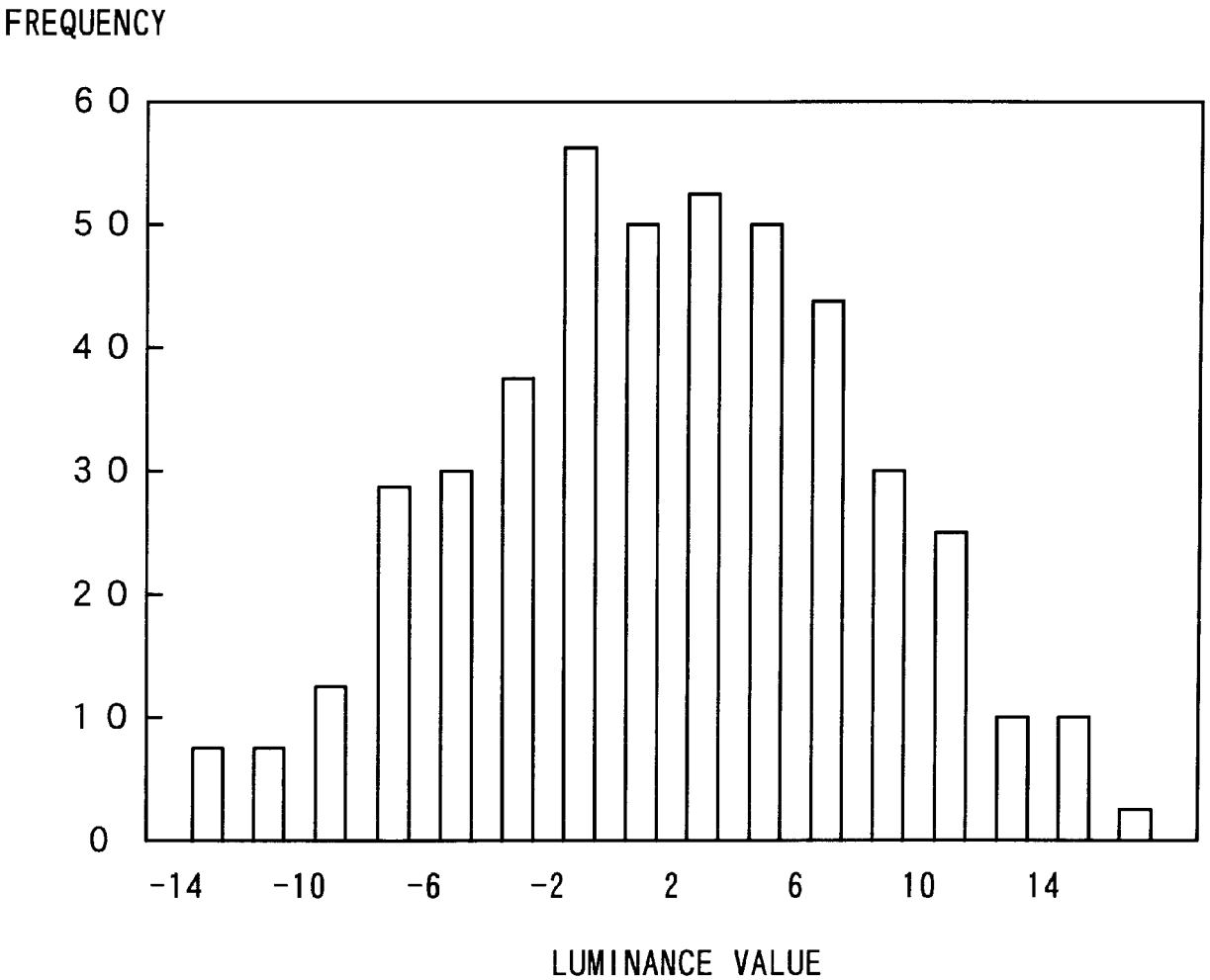
FIG. 8 is a diagram showing a histogram of luminance values of a moving flame.
Figure 9:
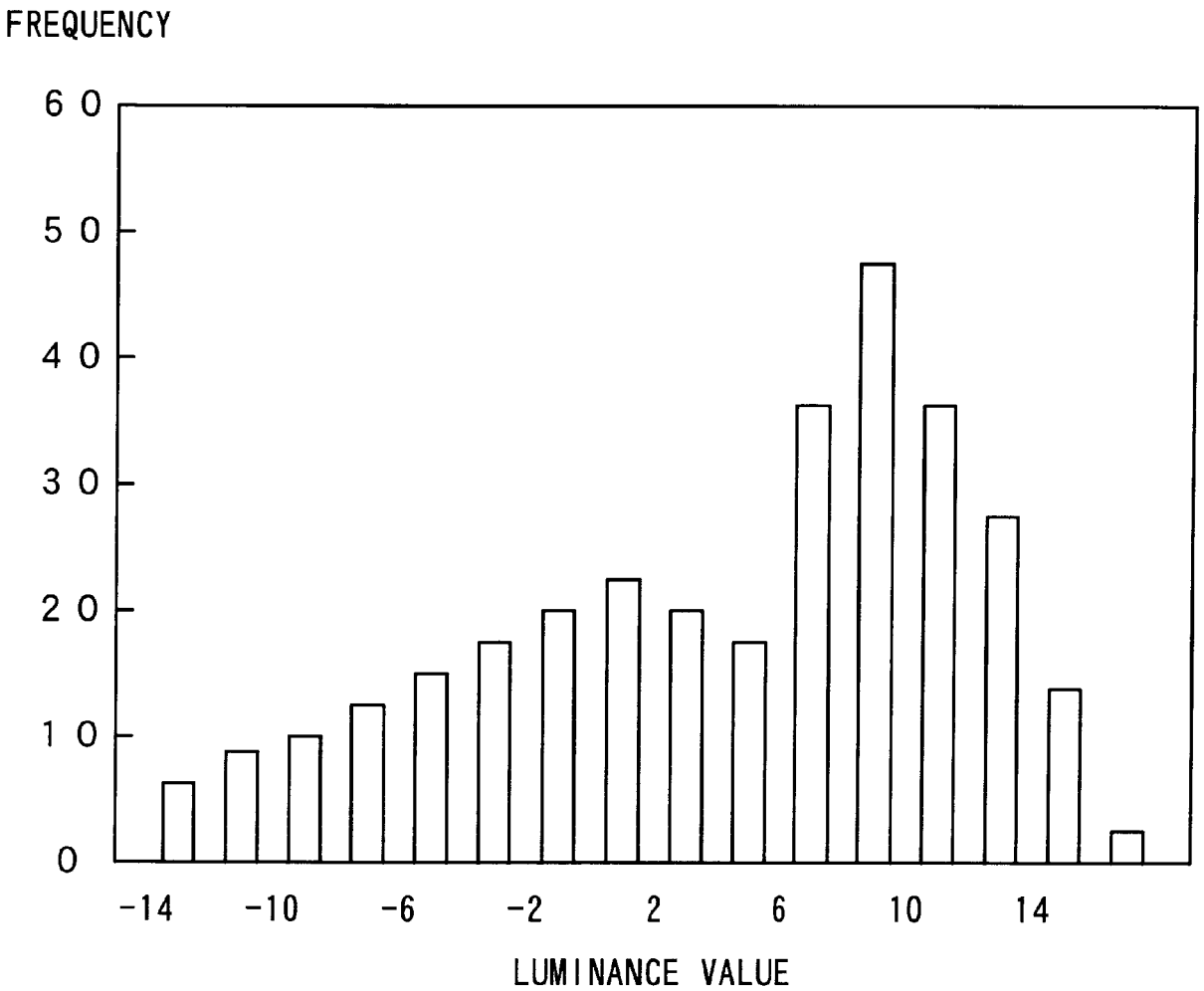
FIG. 9 is a diagram showing a histogram of luminance values of a moving object.

FIG. 8 shows a histogram obtained from a moving flame, and FIG. 9 shows another obtained from a moving object. In both of the figures, the abscissa represents luminance values, and the ordinate represents a frequency of occurrence of each luminance value.

The FIG. 8 histogram shows that the moving flame produces an approximately normal distribution of occurrences (symmetric graph). In contrast, the FIG. 9 histogram of the moving object exhibits a one-sided distribution. Therefore, discrimination of a flame from a moving object can be made by using a symmetrical property of a histogram, as a condition for determining whether an object is a flame or not (i.e. determining that the object is a flame if the histogram exhibits a symmetrical property or a property close thereto).

Figure 10:
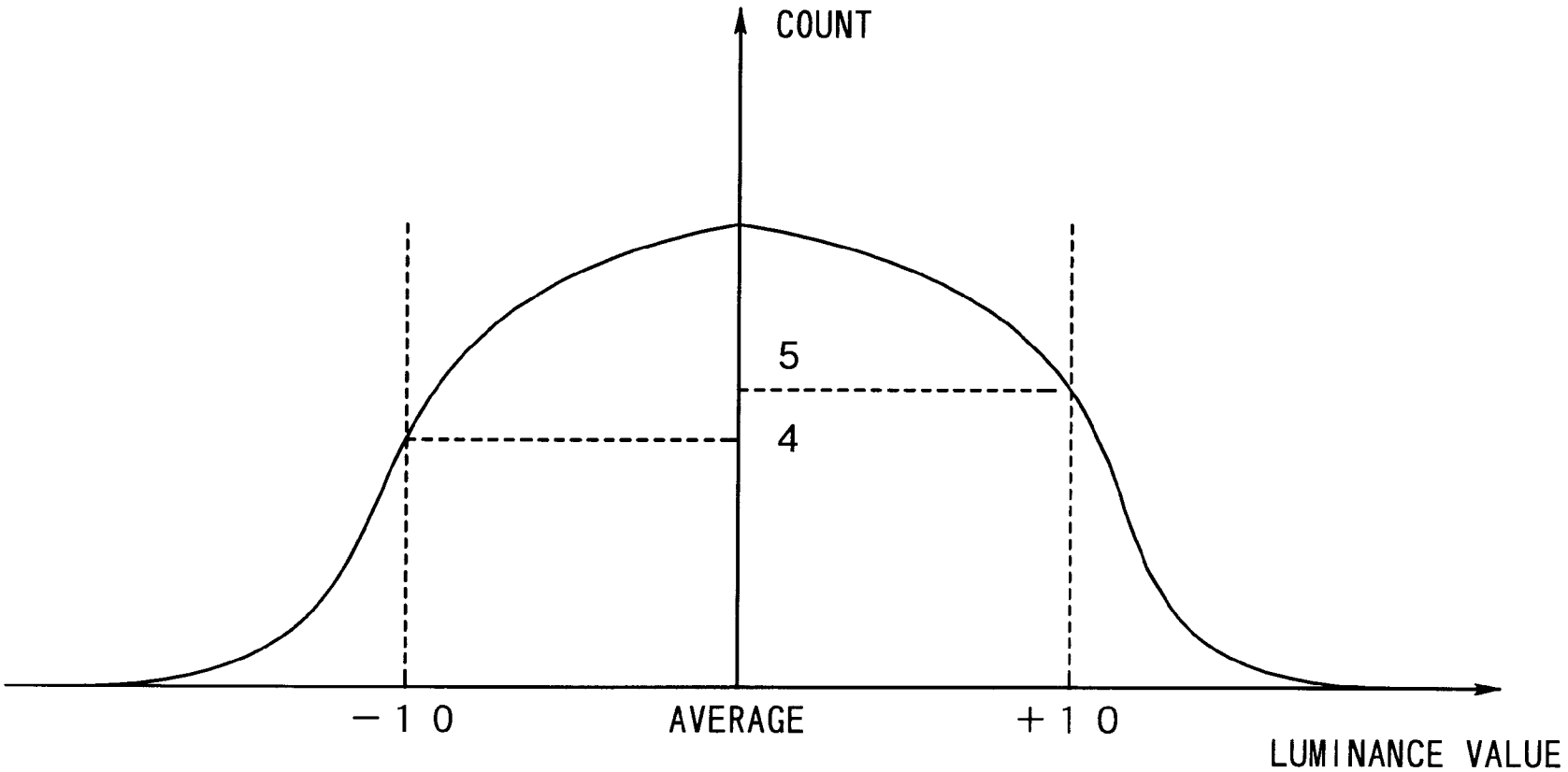
FIG. 10 is a diagram showing a comparison in the count of occurrences of a pair of luminance values whose absolute values are identical.

FIG. 10 shows a comparison between numbers or counts of occurrences of a pair of luminance values whose absolute values are identical. When quantifying the symmetrical property of a histogram, a graph with the average of luminance data as its center is formed from N items of luminance data.

Then, comparison is made between all pairs of points indicative of luminance values whose absolute values are identical. FIG. 10 shows a comparison made between a point for a luminance value of +10 and a point for a luminance value of −10 (the right side of the average in the center of the histogram designates plus values, while the left side of the same designate minus values). The number of data indicative of a luminance value of +10 is five, whereas the number of data indicative of a luminance value of −10 is four. Then, it is determined which is larger, the number of data indicative of the plus luminance value or the number of data indicative of the minus luminance value.

A histogram of a moving object is not symmetrical with respect to an axis of the average value, but shows a one-sided distribution.

Then, using the average value as a reference value, comparison is made between the number of data indicative of a luminance value n points larger than the average value and the number of data indicative of a luminance value n points smaller than the average value. This comparison is carried out over a range of n such that n is increased from 1 to a predetermined value m. The count of cases where the number of data indicative of a luminance value n points larger than the average value is larger than the number of data indicative of a luminance value n points smaller than the average value is set to $n_+$, while the count of cases where the number of data indicative of a luminance value n points larger than the average value is smaller than the number of data indicative of a luminance value n points smaller than the average is set to n−.

Here, a test statistic is defined as the smaller one of $n_+$ and $n_-$, and a significant probability Pm is defined as a probability of a test statistic m, i.e., a probability of a test statistic becoming smaller than m. Similarly to the above, a threshold value is set by consulting the FIG. 7 table, and if the calculated test statistic is equal to or larger than the threshold value, it is determined that the object is a flame, whereas if the former is smaller than the latter, it is determined that the object is not a flame.

Further, it is also possible to determine whether a histogram is symmetrical or not in the following manner: There is calculated a difference between the number of data indicative of a luminance value n points larger than the average value and the number of data indicative of a luminance value n points smaller than the average value, and this difference is obtained for all of n by increasing n from 1 to the predetermined value m, to calculate a sum total of thus-obtained values of the difference. Then, comparison is made between the sum total and a predetermined value.

That is, if the sum total is equal to or larger than the predetermined value, the histogram is considered to be not symmetrical, and hence it is determined that the object is not a flame, whereas if the sum total is smaller than the predetermined value, the histogram is considered to be symmetrical, and hence it is determined that the object is a flame. It should be noted that there are other calculating methods which can be employed for evaluation of a symmetrical property of data, and any method may be employed so long as it enables determination of whether a histogram is symmetrical or not.

As described above, in the third embodiment, a histogram is obtained from luminance data, and in view of properties of a moving flame causing a histogram of luminance data thereof to be symmetrical with the average value of luminance values as a center of the histogram, statistical processing is carried out on the luminance data, and discrimination between a moving flame and a moving object is made, for detection of a fire. This makes it possible to efficiently detect a fire with high accuracy.

Next, a method of determining a moving flame from noise will be described. To accurately extract a movement (movement component) of a flame, it is required to remove noise generated by the camera 14. This noise is an inherent one, which is considered to assume a $X^2$ distribution (normal distribution), and hence can be converted to a parameter of a certain variation (variance).

Here, let it be assumed that $N(\mu, \sigma^2)$ represents a mother population of noise in which $\mu$ represents an average value of variation of noise, and $\sigma^2$ represents a variance, and that sample values are {−5, 1, 3, 8, . . . }and the number of sample data N is 30, for instance. The number N means that the number of luminance data extracted over frames, and the sample values are luminance values of respective data. To determine a moving flame from noise, a luminance data extraction means extracts luminance data. An index calculation means 15 included in resembling means 12 calculates the sum of squares by using the luminance data as samples to calculate an index. More specifically, assuming that the sum of squares of samples is represented by $S=(\cdot(x_i-\langle x\rangle)^2)$, the index is represented by $S/\sigma^2$ ($\sigma^2$ is the variance of the mother population).

Further, the index $S/\sigma^2$ conforms to a $X^2$ distribution having a degree of freedom (N−1). This enables the fire detection means 13 to discriminate between movement of a fire and noise by carrying out a $X^2$ one-sided test by using the index $S/\sigma^2$ as the test statistic.

Figure 11:
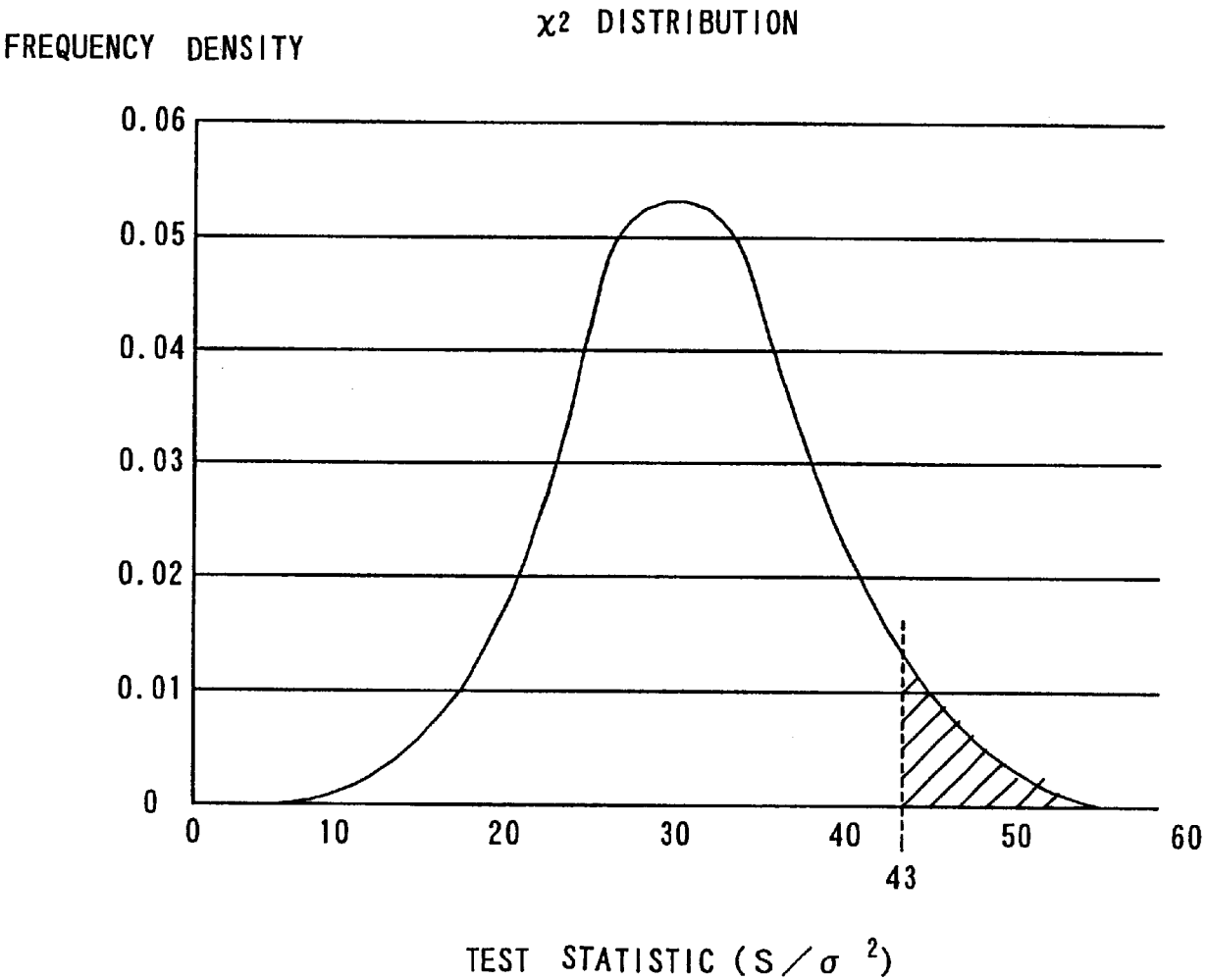
FIG. 11 is a diagram showing a $X^2$ distribution.
Figure 13:
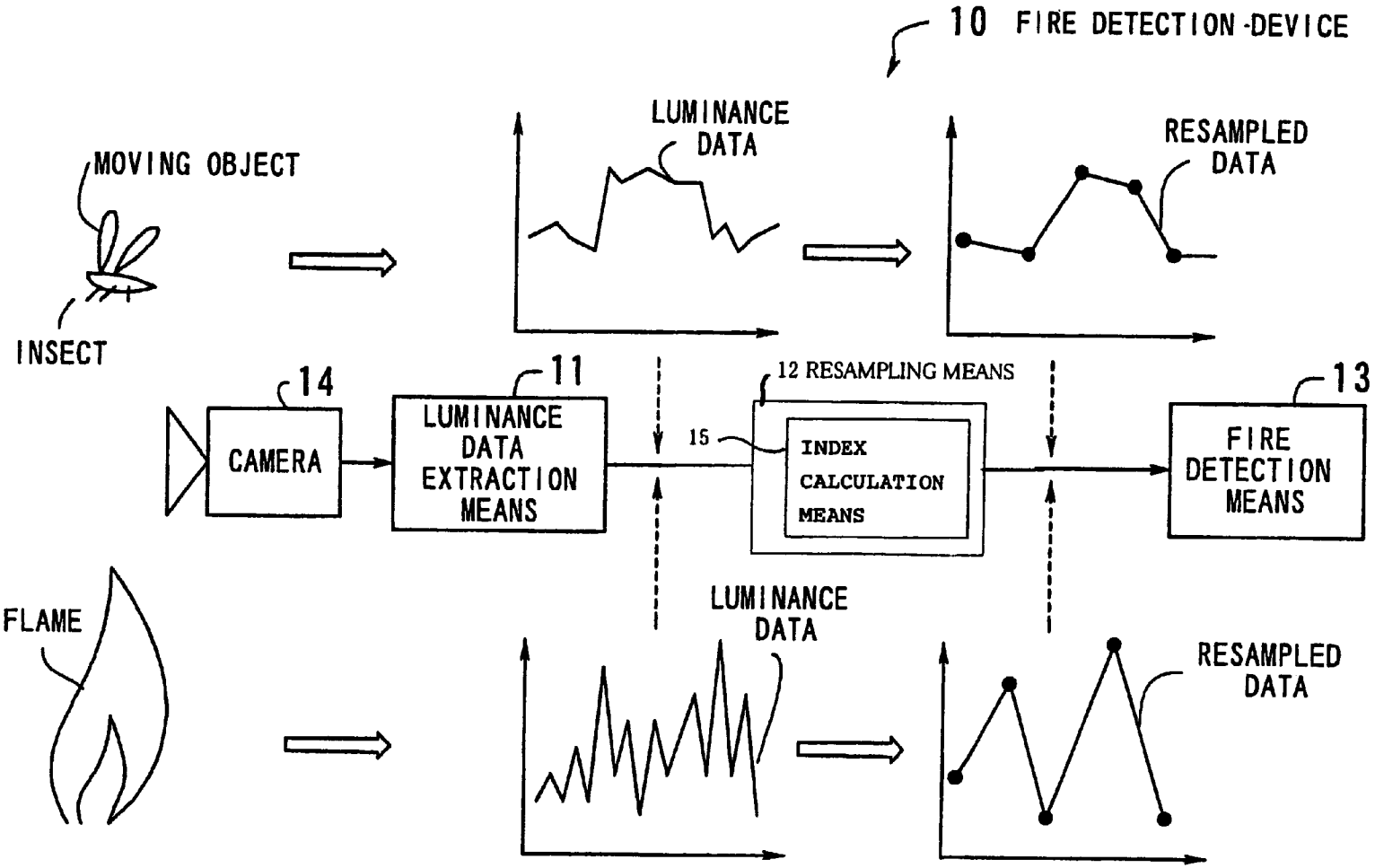
FIG. 13 is a diagram showing the operating principles of a fire detection device according to another embodiment.

FIG. 11 shows a graph of a $X^2$ distribution, in which the ordinate designates probability densities, and the abscissa represents test statistic $S/\sigma^2$. Noise exhibits a $X^2$ distribution as shown in the figure. Here, for instance, the probability of the test statistic $S/\sigma^2$ being equal to or larger than 43 is indicated by a hatched area in the figure.

FIG. 12 shows a table of values of the test statistic and the significant probability. Table T2 is formed by calculating the test statistic $S/\sigma^2$ and the significant probability Pm, assuming that the mother population of noise is N(0, 9), N=30.

In the figure, when the test statistic $S/\sigma^2$ is equal to 43, for instance, the significant probability Pm is equal to 4.6%. This shows that the probability of the index calculated from the samples being equal to or larger than 43 is 4.6%.

Here, the table T2 is formed based on the precondition that noise exhibits a normal distribution. However, since this table T2 shows that the probability of the index becoming equal to or larger than 43 is as low as 4.6%, it can be determined (in the case of a significant level being set to 5%) that the observed object itself is not noise. That is, it is recognized that the object is a moving flame (or a moving object).

The significant level for discriminating a moving flame (or moving object) from noise can be set as desired, but here it is set to 5%. Therefore, assuming that the significant level is 5%, if the test statistic is lower than 42, the object is noise, and if the same is equal to or larger than 43, it can be determined that the object is a moving flame (or moving object).

It should be noted that according to the embodiment of the invention, actually, discrimination between noise and a moving flame is carried out, and thereafter, discrimination between a moving object and a moving flame is carried out, to detect a fire.

It should be noted that according to the present invention, a property of samples is evaluated against the property of a hypothetical mother population of noise, in which the mother population exhibits a normal distribution, to determine whether the former property conforms to the latter property, and thereby discriminate between a moving flame and noise. This makes it possible to efficiently detect a flame with high accuracy.

Further, according to the invention, the mother population of noise, the number of samples, and the significant probability are determined by statistical processing, whereby a threshold value for the discrimination is autonomously determined, so that the setting of a predetermined value can be made quantitative. Therefore, it is no longer required to set a threshold value for each point desired to be monitored for fire detection, on point-by-point basis. This makes it possible to improve the working efficiency and increase flexibility.

Although in the above description, the index calculation means calculates an index from the luminance values of frames, this is not limitative, but the difference in luminance value between frames may be sampled, and the sum of squares may be calculated from the sampled data of the difference, for calculation of the index.

As described heretofore, the fire detection device according to the invention carries out statistical processing to discriminate between a moving flame and a moving object, and between a moving flame and noise, for detection of a fire. This makes it possible to detect a fire alone without being confused by external factors. Further, since an infrared camera or a sensor without temperature measurement capability can be used, it is possible to construct an inexpensive and high-quality system by using the fire detection device.

As described heretofore, the fire detection device according to the invention carries out resampling of luminance data extracted from an input image over a longer time period than a repetition period of movement of a flame to form resampled data, and carries out statistical processing based on the average value of the resampled data and a distribution of signs with respect to the average value, to detect a fire. This makes it possible to efficiently detect a fire with high accuracy.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A fire detection device for detecting a fire, comprising:

luminance data extraction means for extracting luminance data from an input image;

resampling means for carrying out resampling of said luminance data over a time period longer than a repetition period of movement of a flame, to generate resampled data; and fire detection means for calculating an average value of N (natural number equal to or larger than 2) items of said resampled data, and determining that said input image is an image of a flame, by comparison between a count of sampled data items larger than said average value or a count of sampled data items smaller than said average value and a predetermined value.

2. The fire detection device according to claim 1, further comprising:

index calculation means for calculating a sum of squares and a variance by using said luminance data as samples, to calculate an index, wherein said fire detection means carries out statistical processing by applying said index to a mother population of noise, to thereby detect a fire.

3. The fire detection device according to claim 2, wherein said index calculation means calculates said sum of squares and said variance by using differences in luminance value between frames as said samples, to thereby calculate said index.

4. A fire detection device for detecting a fire, comprising:

luminance data extraction means for extracting luminance data from an input image;

resampling means for carrying out resampling of said luminance data over a time period longer than a repetition period of movement of a flame, to generate resampled data; and fire detection means for calculating an average value of items of said resampled data, and determining that said input image is an image of a flame when a difference between a count of sampled data items larger than said average value and a count of sampled data items smaller than said average value is within a predetermined range.

5. The fire detection device according to claim 4, further comprising:

index calculation means for calculating a sum of squares and a variance by using said luminance data as samples, to calculate an index, wherein said fire detection means carries out statistical processing by applying said index to a mother population of noise, to thereby detect a fire.

6. The fire detection device according to claim 5, wherein said index calculation means calculates said sum of squares and said variance by using differences in luminance value between frames as said samples, to thereby calculate said index.

7. A fire detection device for detecting a fire, comprising:

luminance data extraction means for extracting luminance data from an input image;

resampling means for carrying out resampling of said luminance data over a time period longer than a repetition period of movement of a flame, to generate resampled data; and fire detection means for calculating an average value of items of said resampled data, and determining that said input image is not an image of a flame when a difference between a count of sampled data items larger than said average value and a count of sampled data items smaller than said average value is outside a predetermined range.

8. The fire detection device according to claim 7, further comprising:

index calculation means for calculating a sum of squares and a variance by using said luminance data as samples, to calculate an index, wherein said fire detection means carries out statistical processing by applying said index to a mother population of noise, to thereby detect a fire.

9. The fire detection device according to claim 8, wherein said index calculation means calculates said sum of squares and said variance by using differences in luminance value between frames as said samples, to thereby calculate said index.

10. A fire detection device for detecting a fire, comprising:

luminance data extraction means for extracting luminance data from an input image;

resampling means for carrying out resampling of said luminance data over a time period longer than a repetition period of movement of a flame, to generate resampled data; and fire detection means for calculating an average value of N (natural number equal to or larger than 2) items of said resampled data, and determining that said input image is an image of a flame, by comparing a count of occurrences of when the luminance data changes from a positive number to a negative number or from a negative number to a positive number with respect to said average value, or a count of occurrences of when the luminance data does not change from a positive number to a negative number or from a negative number to a positive number with respect to said average value, and a predetermined value.

11. The fire detection device according to claim 10, further comprising:

index calculation means for calculating a sum of squares and a variance by using said luminance data as samples, to calculate an index, wherein said fire detection means carries out statistical processing by applying said index to a mother population of noise, to thereby detect a fire.

12. The fire detection device according to claim 11, wherein said index calculation means calculates said sum of squares and said variance by using differences in luminance value between frames as said samples, to thereby calculate said index.

13. A fire detection device for detecting a fire, comprising:

luminance data extraction means for extracting counts of luminance data from an input image; and fire detection means for calculating an average value of said counts of luminance data, and determining whether or not said counts have a symmetrical property with respect to said average value as an axis of symmetry, said fire detection means determining that said input image is an image of a flame when said counts have said symmetrical property, and determining that said input image is not an image of a flame when said counts do not have said symmetrical property.

14. The fire detection device according to claim 13, further comprising:

index calculation means for calculating a sum of squares and a variance by using said luminance data as samples, to calculate an index, wherein said fire detection means carries out statistical processing by applying said index to a mother population of noise, to thereby detect a fire.

15. The fire detection device according to claim 14, wherein said index calculation means calculates said sum of squares and said variance by using differences in luminance value between frames as said samples, to thereby calculate said index.

16. A fire detection device for detecting a fire, comprising:

luminance data extraction means for extracting luminance data from an input image; and index calculation means for calculating a sum of squares and a variance by using said luminance data as samples, to calculate an index; and fire detection means for carrying out statistical processing by applying said index to a mother population of noise, to thereby detect a fire.

17. A fire detection device according to claim 16, wherein said index calculation means calculates said sum of squares and said variance by using differences in luminance value between frames as said samples, to thereby calculate said index.

18. A fire detection device for detecting a fire, comprising:

an extractor for extracting luminance data from an input image;

a resampler for resampling said luminance data over a time period longer than a repetition period of movement of a flame, to generate resampled data; and a fire detector for calculating an average value of N (natural number equal to or larger than 2) items of said resampled data, and determining that said input image is an image of a flame, by comparing a count of sampled data items larger than said average value or a count of sampled data items smaller than said average value, and a predetermined value.

19. The fire detection device according to claim 18, further comprising:

an index calculator for calculating a sum of squares and a variance by using said luminance data as samples, to calculate an index, wherein said detector carries out statistical processing by applying said index to a mother population of noise, to thereby detect a fire.

20. The fire detection device according to claim 19, wherein said index calculator calculates said sum of squares and said variance by using differences in luminance value between frames as said samples, to thereby calculate said index.

21. A fire detection device for detecting a fire, comprising:

an extractor for extracting luminance data from an input image;

a resampler for resampling said luminance data over a time period longer than a repetition period of movement of a flame, to generate resampled data; and a fire detector for calculating an average value of items of said resampled data, and determining that said input image is an image of a flame when a difference between a count of sampled data items larger than said average value and a count of sampled data items smaller than said average value is within a predetermined range.

22. The fire detection device according to claim 21, further comprising:

an index calculator for calculating a sum of squares and a variance by using said luminance data as samples, to calculate an index, wherein said fire detector carries out statistical processing by applying said index to a mother population of noise, to thereby detect a fire.

23. The fire detection device according to claim 22, wherein said index calculator calculates said sum of squares and said variance by using differences in luminance value between frames as said samples, to thereby calculate said index.

24. A fire detection device for detecting a fire, comprising:

an extractor for extracting luminance data from an input image;

a resampler for resampling of said luminance data over a time period longer than a repetition period of movement of a flame, to generate resampled data; and a fire detector for calculating an average value of items of said resampled data, and determining that said input image is not an image of a flame when a difference between a count of sampled data items larger than said average value and a count of sampled data items smaller than said average value is outside a predetermined range.

25. The fire detection device according to claim 24, further comprising:

an index calculator for calculating a sum of squares and a variance by using said luminance data as samples, to calculate an index, wherein said detector carries out statistical processing by applying said index to a mother population of noise, to thereby detect a fire.

26. The fire detection device according to claim 25, wherein said index calculator calculates said sum of squares and said variance by using differences in luminance value between frames as said samples, to thereby calculate said index.

27. A fire detection device for detecting a fire, comprising:

an extractor for extracting luminance data from an input image;

a resampler for resampling of said luminance data over a time period longer than a repetition period of movement of a flame, to generate resampled data; and a fire detector for calculating an average value of N (natural number equal to or larger than 2) items of said resampled data, and determining that said input image is an image of a flame, by comparing a count of occurrences of when the luminance data changes from a positive number to a negative number or from a negative number to a positive number, with respect to said average value, or a count of occurrences when the luminance data does not change from a positive number to a negative number or from a negative number to a positive number with respect to said average value, and a predetermined value.

28. The fire detection device according to claim 27, further comprising:

an index calculator for calculating a sum of squares and a variance by using said luminance data as samples, to calculate an index, wherein said detector carries out statistical processing by applying said index to a mother population of noise, to thereby detect a fire.

29. The fire detection device according to claim 28, wherein said index calculator calculates said sum of squares and said variance by using differences in luminance value between frames as said samples, to thereby calculate said index.

30. A fire detection device for detecting a fire, comprising:

an extractor for extracting counts of luminance data from an input image; and a fire detector for calculating an average value of said counts of luminance data, and determining whether or not said counts have a symmetrical property with respect to said average value as an axis of symmetry, said fire detector determining that said input image is an image of a flame when said counts have said symmetrical property, and determining that said input image is not an image of a flame when said counts do not have said symmetrical property.

31. The fire detection device according to in claim 30, further comprising:

an index calculator for calculating a sum of squares and a variance by using said luminance data as samples, to calculate an index, wherein said fire detector carries out statistical processing by applying said index to a mother population of noise, to thereby detect a fire.

32. The fire detection device according to claim 31, wherein said index calculator calculates said sum of squares and said variance by using differences in luminance value between frames as said samples, to thereby calculate said index.

33. A fire detection device for detecting a fire, comprising:

an extractor for extracting luminance data from an input image; and an index calculator for calculating a sum of squares and a variance by using said luminance data as samples, to calculate an index; and a fire detector for carrying out statistical processing by applying said index to a mother population of noise, to thereby detect a fire.

34. A fire detection device according to claim 33, wherein said index calculator calculates said sum of squares and said variance by using differences in luminance value between frames as said samples, to thereby calculate said index.

* * * * *